US006715311B1

(12) United States Patent
Wasnock et al.

(10) Patent No.: US 6,715,311 B1
(45) Date of Patent: Apr. 6, 2004

(54) BI-FOLDING DOORS FOR AIR DISTRIBUTION PLENUM

(75) Inventors: Leonard M. Wasnock, Granger, IN (US); William Teeter, Niles, MI (US); Rick Waldron, Niles, MI (US); Bill Wagnerowski, South Bend, IN (US); Jim Hansen, Niles, MI (US)

(73) Assignee: Carrier Commercial Refrigeration, Inc., Syracuse, NY (US)

( * ) Notice: Subject to any disclaimer, the term of this patent is extended or adjusted under 35 U.S.C. 154(b) by 0 days.

(21) Appl. No.: 10/246,290

(22) Filed: Sep. 18, 2002

(51) Int. Cl.[7] ..... F25D 23/02; F25D 17/04; F25D 11/00; F25D 25/00; F24F 13/18; E06B 7/02

(52) U.S. Cl. ..... 62/265; 454/195; 62/408; 62/440; 62/466; 160/84.05

(58) Field of Search ..... 62/265, 255–260, 62/267, 408, 418, 419, 237, 253, 246, 249, 440–466; 160/84.05; 454/195

(56) References Cited

U.S. PATENT DOCUMENTS 4,402,192 A * 9/1983 Henry ..... 62/256
4,962,649 A * 10/1990 Battocletti ..... 62/256
5,655,595 A * 8/1997 Westbrooks, Jr. ..... 165/48.1
5,675,985 A * 10/1997 Lee ..... 62/408
5,797,280 A * 8/1998 Lee ..... 62/408
5,875,642 A * 3/1999 Lee et al. ..... 62/256
6,351,964 B1 * 3/2002 Brancheau et al. ..... 62/249

* cited by examiner

*Primary Examiner*—William C. Doerrler
*Assistant Examiner*—Filip Zec
(74) *Attorney, Agent, or Firm*—Carlson, Gaskey & Olds

(57) ABSTRACT

An air distribution bi-folding door assembly of a refrigerated case opens and closes to allow for the loading of refrigerated items in the case. The doors are attached by a hinge. Each door is hollow and includes perforations which allow cool air which flows in the hollow space of the doors to distribute over the refrigerated items in the case. A wheel assembly is attached to the upper outer corner of each door and runs along a track as the doors open and close. An alignment assembly attached to the lower outer corners of each door ensures proper alignment of the doors during opening and closing.

21 Claims, 4 Drawing Sheets

BI-FOLDING DOORS FOR AIR DISTRIBUTION PLENUM

BACKGROUND OF THE INVENTION

The present invention relates generally to a refrigerated case including an air distribution bi-folding door assembly including hollow doors with perforations which allow cool air to flow through the perforations to cool refrigerated items in the refrigerated case.

Refrigerated cases are employed to allow shoppers to access groceries and other refrigerated items from the front of the case without the obstruction of a door. The refrigerated items are stocked from the rear of the case to allow restocking of the case without interruption of customer traffic. The National Sanitary Standard requires that the temperature range in the case be between 32° F. and 43° F.

In a prior art refrigerated case, a walk-in cooler adjacent to the rear of the case maintains freshness of the refrigerated items prior to being stocked in the case. A divider, such as a curtain, typically separates the rear of the refrigerated case from the cooler. The divider is typically attached by a plurality of metal hooks which roll across a metal track.

SUMMARY OF THE INVENTION

A refrigerated case includes an air distribution bi-folding door assembly which opens and closes to allow for the loading of refrigerated items in the case. A first door and a second door are connected by hinges, which allows the doors to fold together for the loading of refrigerated items in the refrigerated case.

Pressurized air enters a hollow space in each door from an opening at the top of doors and flows through the perforations for distribution over the refrigerated items in the case. A corner bracket is secured in each of the four corners of the first and second doors by attachment members.

A wheel assembly is attached to the upper outer corner bracket by a rod. The wheel assembly includes four wheels which run along an upper track. As the door assembly is opened and closed and the wheels run along the upper track, the rod pivots in the wheel assembly, allowing the doors to pivot and open and close.

An alignment assembly attached to the bottom outer corner bracket keeps the doors in proper alignment during opening and closing. A nylon bushing of the alignment assembly is received in an opening in a lower track to guide the doors and ensure proper alignment.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawing that accompany the detailed description can be briefly described as follows.

DETAILED DESCRIPTION OF THE PREFERRED EMBODIMENT

Figure 1:
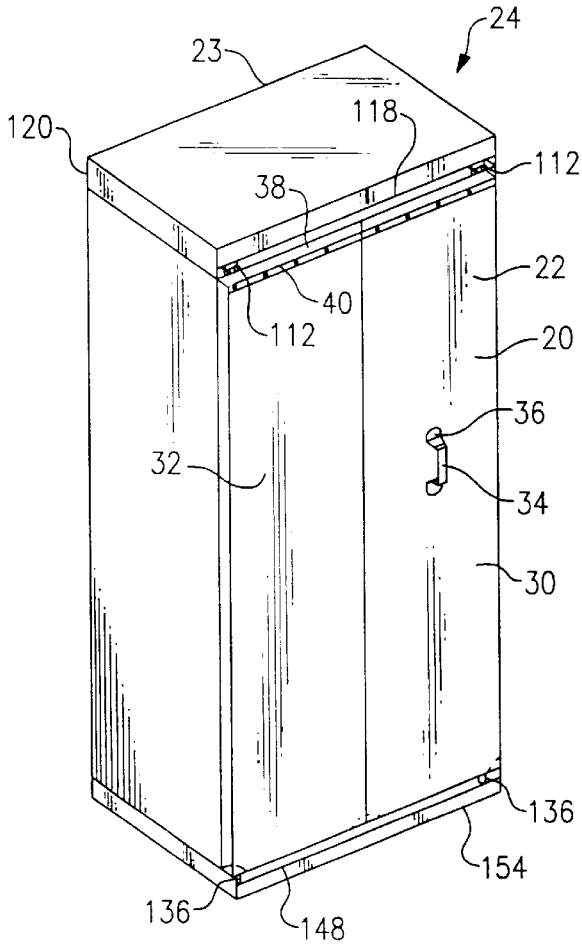
FIG. 1 illustrates a schematic outer perspective view of the door assembly of the present invention in the closed position.
Figure 2:
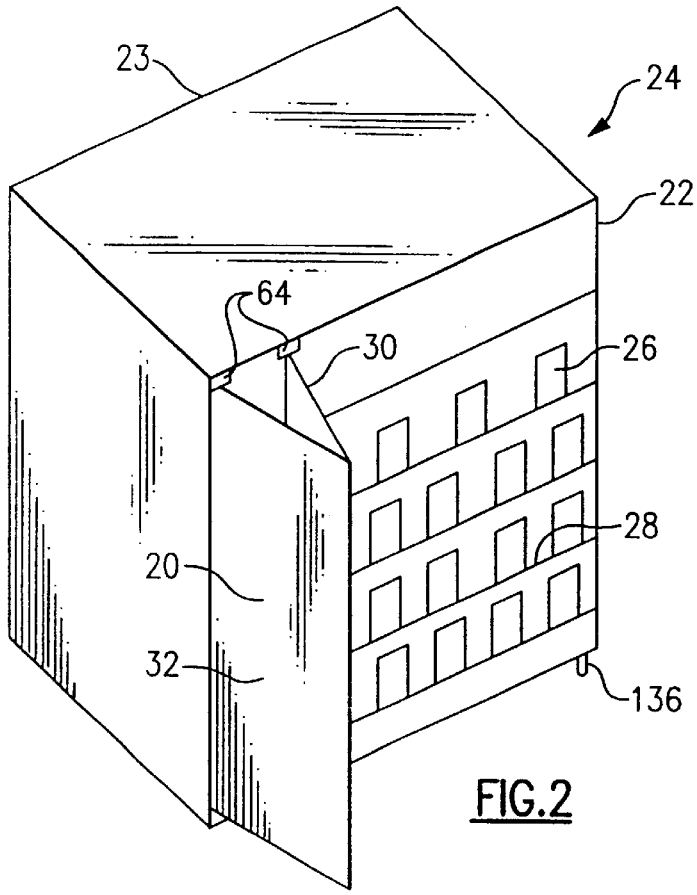
FIG. 2 illustrates a schematic outer perspective view of the door assembly of FIG. 1 in the open position.

FIG. 1 schematically illustrates an outside perspective view of the door assembly 20 of the present invention on the rear 22 of a refrigerated case 24 in the closed position. As shown in FIG. 2, refrigerated items 26, such as dairy items, are stocked onto shelves 28 in the case 24 from the rear 22 when the door assembly 20 is in an open position. Customers access the refrigerated items 26 from the front 23 of the case 24.

Returning to FIG. 1, the door assembly 20 includes a first door 30 and a second door 32. Preferably, both doors 30 and 32 are made of metal. A handle 34 is secured to one of the doors 30 and 32 by attachment members 36 to allow for opening and closing of the door assembly 20. Although the handle 34 is shown attached to the first door 30 in FIG. 1, the handle 34 can also be attached to the second door 32. In one example, the attachment members 36 are screws. A brush strip 38 attached to the upper edge 40 of the from 23 of the case 24 prevents leakage of cooled air from the case 24. The brush strip 38 is attached to a brush holder 160 secured to the case 24 by an attachment member 162 (shown in FIG. 8). Preferably, the attachment member 162 is a screw.

Figure 3:
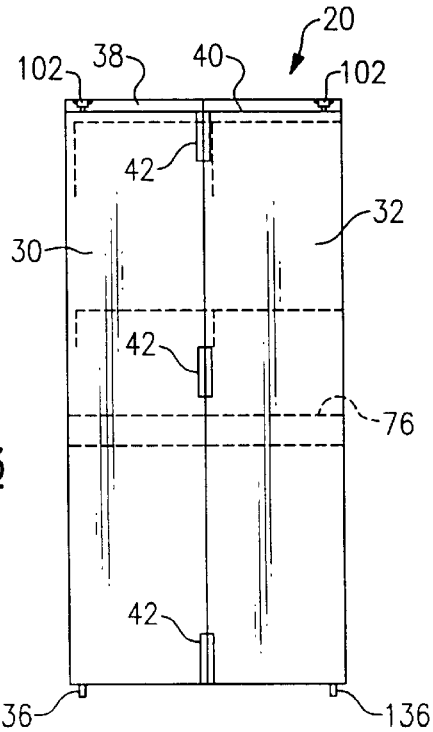
FIG. 3 illustrates a schematic inner view of the door assembly.

FIG. 3 schematically illustrates an inside view of the door assembly 20 in the closed position. The doors 30 and 32 are connected by hinges 42 which allows the doors 30 and 32 to fold together in the open position of FIG. 2 for the loading of refrigerated items 26. Although three hinges 42 are illustrated and described, it is to be understood that any numbers of hinges 42 can be employed. Preferably, the hinge 42 is a piano hinge.

Figure 4:
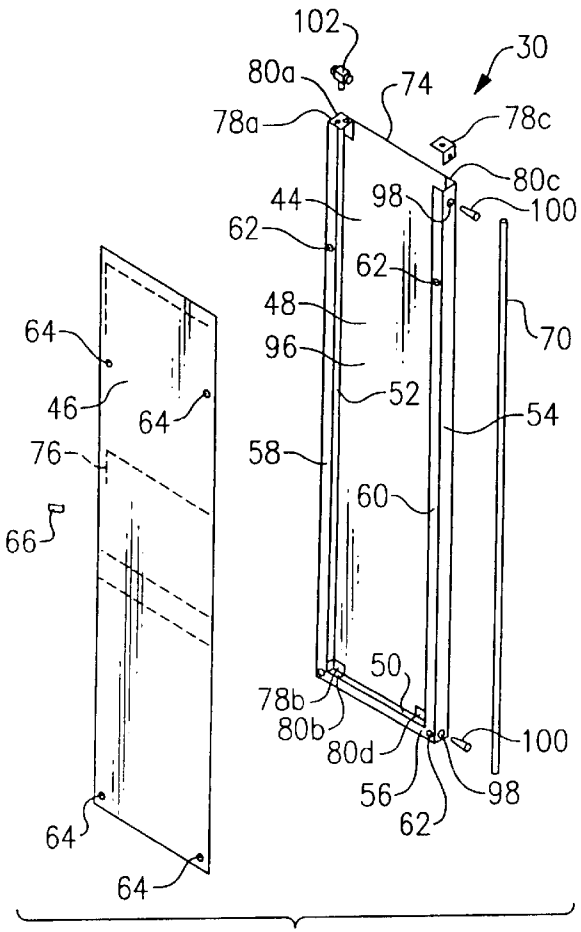
FIG. 4 illustrates a schematic perspective exploded inner view of one of the doors of the door assembly.
Figure 5:
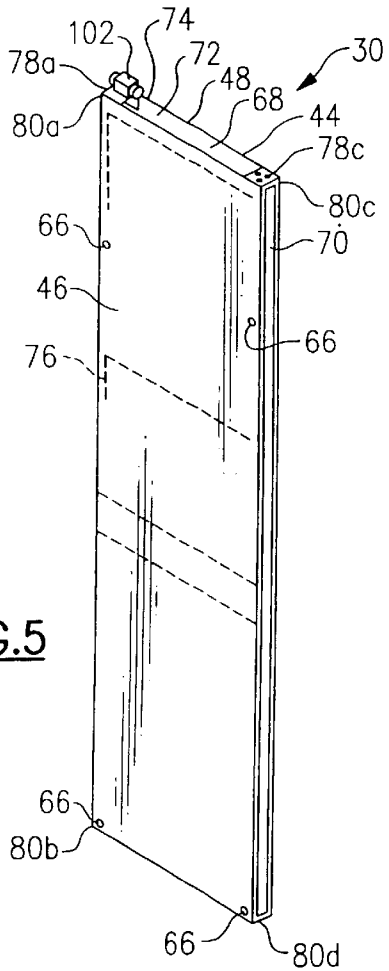
FIG. 5 illustrates a schematic perspective inner view of the door of FIG. 3 assembled.

FIGS. 4 and 5 illustrate a perspective inner view of the first door 30. The first door is described and illustrated in FIGS. 4 and 5. Although the second door 32 is not specifically illustrated and described, it is to be understood that the second door 32 is the mirror image of the first door 30 and includes the same features.

FIG. 4 illustrates an inner exploded view of the first door 30. The first door 30 includes a boxed door panel 44 and a flat perforated panel 46. The boxed door panel 44 includes a flat panel 48, a bottom portion 50, an outer side portion 52, and an inner side portion 54. Preferably, the portions 50, 52, 54 are perpendicular to the flat panel 48. The portions 50, 52 and 54 each include a flange 56, 58 and 60, respectively, having a plurality of attachment holes 62.

The flat perforated panel 46 includes a plurality of attachment holes 64 which align with the attachment holes 62 of the boxed door panel 44 when the flat perforated panel 46 is positioned on the boxed door panel 44. Attachment members 66 pass through the aligned holes 62 and 64 to secure the flat perforated panel 46 to the boxed door panel 44, creating a hollow space 68 between the boxed door panel 46 and the flat perforated panel 44 (shown in FIG. 5). In one example, the attachment members 66 are screws. The number of holes 62 and 64 and attachment members 66 employed are sufficient to secure the flat perforated panel 46 to the boxed door panel 44.

A gasket 70 (shown in FIG. 5) adhered to one of the side portions 52 and 54 prevents air leakage. In one example, the gasket 70 is made of foam rubber and has a D-shaped cross section. The gasket 70 is attached to the first door 30 by an adhesion member, such as double sided tape.

FIG. 5 illustrates the first door 30 after assembly of the flat perforated panel 46 to the boxed door panel 44. Pressurized air enters hollow space 68 from an opening 72 at the upper edge 74 of first door 30, allowing cool pressurized air to flow through the hollow space 68 and through a plurality of air holes 76 in the flat perforated plate 32 for distribution over the refrigerated items 26 in the case 24. The plurality of air holes 76 are located in a pattern to provide cooling over the refrigerated items 26 in the case 24.

A corner bracket 78 is secured in each of the four corners 80 of the first door 30. An upper outer corner bracket 78*a* and a lower outer corner bracket 78*b* are secured in the upper outer corner 80*a* and lower outer corner 80*b*, respectively, of the first door 30. An upper inner corner bracket 78*c* and a lower inner corner bracket (not shown) are secured in the upper inner corner 80*c* and lower inner corner 80*d*, respectively, of the first door 30.

Figure 6:
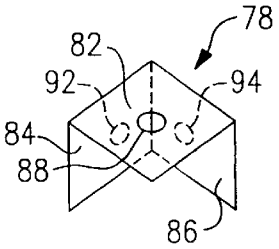
FIG. 6 illustrates a schematic perspective view of a corner bracket.

FIG. 6 schematically illustrates the corner bracket 78. Each corner bracket 78 includes a first portion 82 having a hole 88 and two side portions 84 and 86 each having a hole 92 and 94, respectively. A corner bracket 78 is positioned in each corner 80 of the door 30 such that one of the side portions 84 and 86 contacts the flat outer panel 48 and the other of the side portions 84 and 86 contacts one of the side portions 52 and 54 of the boxed door panel 44. When a corner brackets 78 is positioned in each of the four corners 80, the holes 92 and 94 align with holes 98 in the four corners 80. Attachment members 100 pass through the aligned holes 92, 94 and 98 to secure the corner brackets 78 to the first door 30. Preferably, the attachment members 100 are screws. A hex nut 156 (shown in FIG. 8) is tack welded over the aperture 88 on the inner surface of each of the corner brackets 78, allowing the corner brackets 78 to be interchangeable between the upper corners 80*a* and 80*c* and the lower corners 80*b* and 80*d*.

Figure 7:
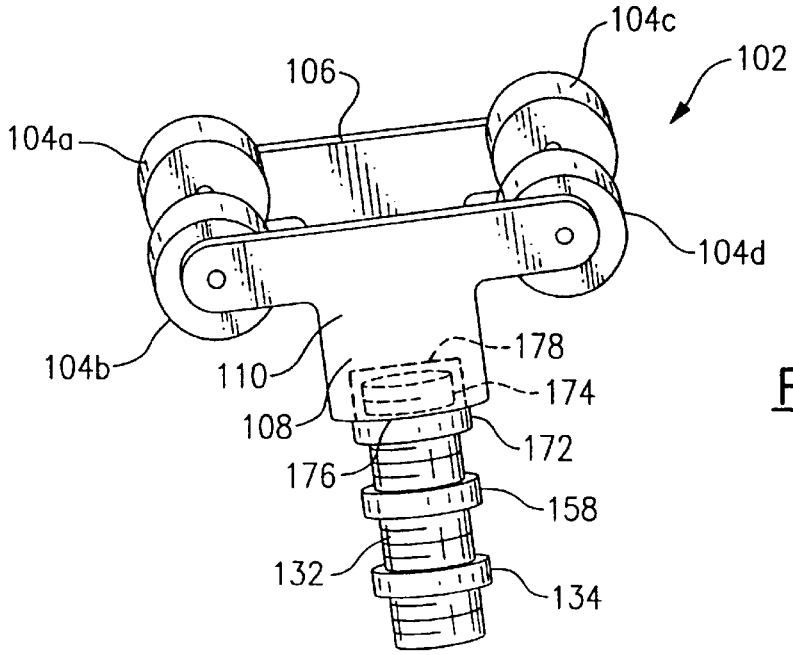
FIG. 7 illustrates a schematic perspective view of a wheel assembly.

Returning to FIG. 4, a wheel assembly 102 is secured to the upper outer corner bracket 78*a*. As shown in FIG. 7, each wheel assembly 102 includes four wheels 104 attached to a wheel housing 108. In one example, the wheels 104 are made of nylon. Two of the wheels 104*a* and 104*c* are rotatably attached to a first side 106 of a wheel housing 108 and two of the wheels 104*b* and 104*d* are rotatably attached to a second side 110 of the wheel housing 108.

Figure 8:
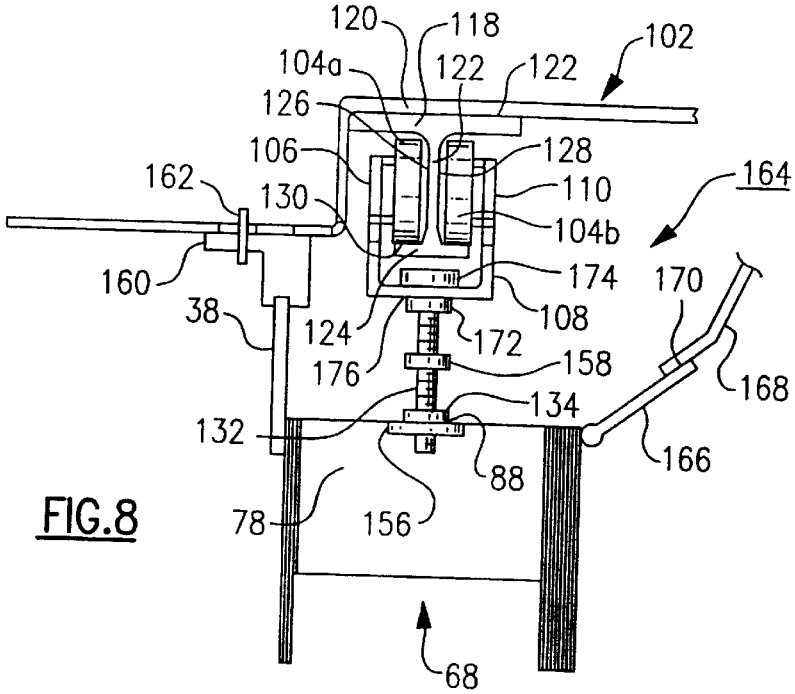
FIG. 8 illustrates a schematic side view of the wheel assembly attached to the upper track.

As shown in FIG. 8, the wheels 104 of the wheel assembly 102 run along an extruded aluminum upper track 118 mounted to the air intake housing 120. The aluminum upper track 118 has an I-shaped cross section and has an upper portion 122 attached to the air intake housing 120, a middle portion 122 and a bottom portion 124. The wheels 104*a* and 104*c* are positioned on a first side 126 of the middle portion 122, and the wheels 104*b* and 104*d* are positioned on a second side 128 of the middle portion 122 such that the wheel assembly 102 hangs from the upper track 118. As the door assembly 20 is opened and closed, the outer surface 130 of the wheels 104 run along the bottom portion 124 of the upper track 118.

An end of a threaded rod 132 is received in a bushing 174 in the wheel housing 108, securing the rod 132 to the wheel housing 108. The bushing 174 is inserted in the wheel housing 108 through a slot 178 (shown in FIG. 7). As the door assembly 20 is opened and closed and the wheels 104 travel along the upper track 118, the rod 132 pivots in the bushing 174, allowing the doors 30 and 32 of the door assembly 20 to open and close.

An upper internally threaded nut 172, a lower internally threaded nut 134, and a middle lock nut 158 are positioned on the rod 132. The upper nut 172 is positioned over an aperture 176 of the wheel housing 108, and the lower nut 134 is positioned over the aperture 88 of the upper corner bracket 78*a*. The upper nut 172 and the lower nut 134 retain the wheel assembly 102 and the corner bracket 78, respectively, in place during opening and closing of the door assembly 20.

If the rod 132 is to be removed from the wheel assembly 102, the upper nut 172 is loosened to allow removal of the rod 132 from the wheel assembly 102. The middle lock nut 158 on the rod 132 is used to adjust the height of the doors 30 and 32. As the middle lock nut 158 is turned, the rod 132 turns and translates, adjusting the height of the doors 30 and 32. If the height of the doors 30 and 32 is adjusted, the lower nut 134 is loosened first to allow for the adjustment. After the height is adjusted, the lower nut 134 is then retightened.

Figure 9:
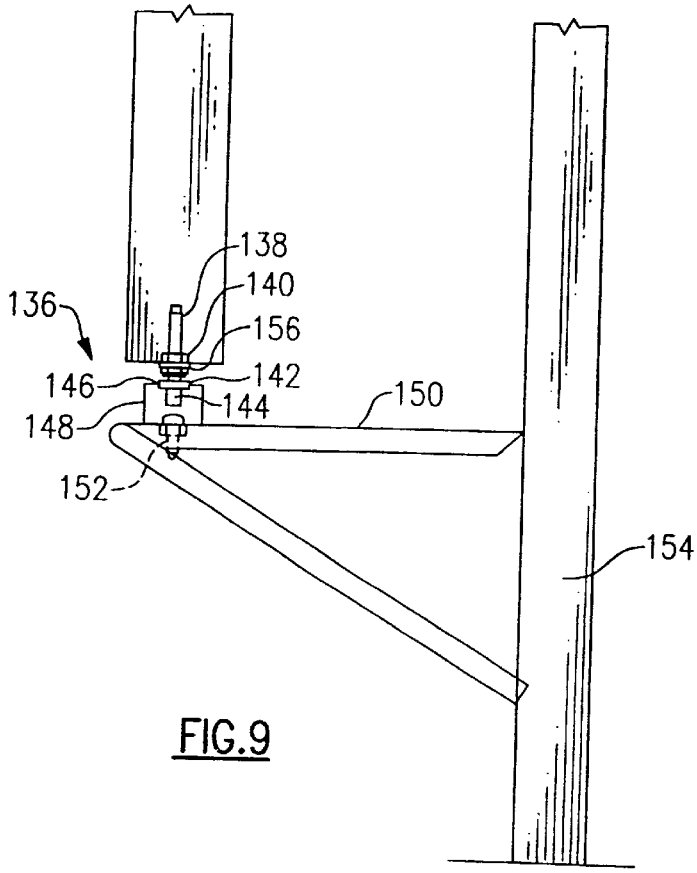
FIG. 9 illustrates a schematic side view of the alignment assembly attached to the lower track.

FIG. 9 illustrates the alignment assembly 136 attached to the lower outer corner bracket 78*b* to maintain the first door 30 in proper alignment during opening and closing of the door assembly 20. A threaded shoulder screw 138 is received in the aperture 88 (shown in FIG. 6) of the lower outer corner bracket 78*b*. An internally threaded nut 140 secures the shoulder screw 138 to the lower outer corner bracket 78*b*.

A nylon bushing 142 mounted on the body 144 of the shoulder screw 138 is received in an opening 146 of a formed steel lower track 148, ensuring proper alignment of the door assembly 20 during opening and closing. The lower track 148 preferably has a C-shaped cross-section and is assembled to a sheet metal bracket 150 by an attachment member 152. Preferably, the attachment member 152 is a screw. The sheet metal bracket 150 is preferably secured to the support uprights 154 of the refrigerated case 24 by welding. In one example, the sheet metal bracket 150 has a U-shaped cross section. As the door assembly 20 is opened and closed and the bushing 142 travels in the opening 146 of the lower track 148, the lower bracket 78*b* pivots about the shoulder screw 138, ensuring proper alignment of the door assembly 20.

As further shown in FIG. 8, cool air from a refrigeration source 164 flows into the hollow space 68 of the doors 30 and 32. When the door assembly 20 is closed, the cool air is prevented from entering the interior of the refrigerated case 24 from the refrigeration source 164 by a metal chute 168. When the door assembly 20 is closed, a foam gasket 166 secured to the metal chute 168 by an attachment member 170 contacts the doors 30 and 32 to prevent entry of the cool air in the interior of the refrigerated case 24. Preferably, the attachment member 170 is double sided tape.

When the doors 30 and 32 are to be installed in the refrigerated case 24, a short section, such as six feet, of the upper track 118 is removed. The bushing 146 of the door 30 is inserted into the opening 146 of the lower track 148. The door 30 is pushed up to the vertical position to align the wheel assemblies 102 in the upper track 118. The door 30 is then slid horizontally. The door 32 is installed in the same manner. After the doors 30 and 32 have been installed, the section of upper track 118 is reinstalled.

The height of the doors 30 and 32 are adjusted by repositioning the lock nut 158 of the threaded rod 132 (shown in FIG. 8). Each wheel assembly 102 can be raised or lowered by moving the lock nut 158 to make the distance between each of the doors 30 and 32 and the upper track 118 are equal.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A refrigerated case comprising:

a door assembly including a first door and a second door moveable between an open position and a closed position, said first door and said second door each having a hollow interior, an inner panel, and a plurality of holes on said inner panel; and a cooling system to produce cool air, and said cool air enters said hollow interior and flows through said plurality of holes for entry into the refrigerated case.

2. The refrigerated case as recited in claim 1 wherein said first door and said second door are metal.

3. The refrigerated case as recited in claim 1 wherein said first door and said second door are connected by at least one hinge, and said first door pivots relative to said second door to move said door assembly between said open position and said closed position.

4. The refrigerated case as recited in claim 1 wherein said first door and said second door each include a boxed door panel, and said boxed door panel includes an outer panel, a bottom portion, an outer side portion and an inner side portion, and said inner panel is attached to said boxed door panel to define said hollow interior therebetween.

5. The refrigerated case as recited in claim 4 further including a gasket adhered to at least one of said outer side portion and said inner side portion of said first door and said second door.

6. The refrigerated case as recited in claim 1 wherein said first door and said second door each include an upper outer corner, an upper inner corner, a lower outer corner, and a lower inner corner, and a bracket is secured to each of said upper outer corner, said upper inner corner, said lower outer corner, and said lower inner corner of said first door and said second door.

7. The refrigerated case as recited in claim 6 further including a wheel assembly attached to said bracket at said upper outer corner of each of said first door and said second door.

8. The refrigerated case as recited in claim 7 further including an upper track, and wherein said wheel assembly further includes four wheels, and said four wheels travel along said upper track as said door assembly moves between said open position and said closed position.

9. The refrigerated case as recited in claim 8 wherein said wheel assembly further includes a threaded rod and said upper corner bracket further includes an aperture, and said threaded rod is received in said aperture in said upper corner bracket to secure said wheel assembly to said door, and said threaded rod pivots in said aperture as said door assembly moves between said open position and said closed position.

10. The refrigerated case as recited in claim 6 further including an alignment assembly attached to said lower outer corner of each of said first door and said second door.

11. The refrigerated case as recited in claim 10 further including a lower track, and wherein said alignment assembly includes a bushing, and said bushing travels in said lower track as said door assembly moves between said open position and said closed position to maintain alignment of said door assembly.

12. The refrigerated case as recited in claim 11 further including a shoulder screw, and said lower corner bracket further includes an aperture, and said shoulder screw is received in said aperture in said lower corner bracket to secure said alignment assembly to said first door and said second door, and said shoulder screw pivots in said aperture as said door assembly moves between said open position and said closed position.

13. A refrigerated case comprising:

a door assembly including a first door and a second door connected by at least one hinge and said first door pivots relative to said second door as said door assembly moves between an open position and a closed position, each of said first door and said second door including a hollow interior, an inner panel, and a plurality of holes on said inner panel of said first door and said second door, and said first door and said second door each include a boxed door panel having an outer panel, a bottom portion, an outer side portion and an inner side portion, and said inner panel is attached to said boxed door panel to define said hollow interior therebetween; and a cooling system to produce cool air which enters said hollow interior and flows through said plurality of holes for entry into the refrigerated case.

14. The refrigerated case as recited in claim 13 wherein said first door and said second door each include an upper outer corner, an upper inner corner, a lower outer corner, and a lower inner corner, and a bracket is secured to each of said upper outer corner, said upper inner corner, said lower outer corner, and said lower inner corner of said first door and said second door.

15. The refrigerated case as recited in claim 14 further including an upper track and a wheel assembly having four wheels, and said four wheels travel along said upper track as said door assembly moves between said open position and said closed position and is attached to said upper outer corner bracket of each of said first door and said second door.

16. The refrigerated case as recited in claim 15 wherein said wheel assembly further includes a threaded rod and said upper corner bracket further includes an aperture, and said threaded rod is received in said threaded rod is received in said aperture in said upper corner bracket to secure said wheel assembly to said door, and said rod pivots in said aperture as said door assembly moves between said open position and said closed position.

17. The refrigerated case as recited in claim 13 further including a lower track and an alignment assembly having a bushing, and said bushing travels in said lower track as said door assembly moves between said open position and said closed position to maintain alignment of said door assembly, and said alignment assembly is attached to said lower outer corner of each of said first door and said second door.

18. The refrigerated case as recited in claim 17 further including a shoulder screw, and said lower corner bracket further includes an aperture, and said shoulder screw is received in said aperture in said lower corner bracket to secure said alignment assembly to said first door and said second door, and said shoulder screw pivots in said aperture as said door assembly moves between said open position and said closed position.

19. A door assembly comprising:

a first door having first hollow interior, a first inner flat panel, and a plurality of first holes on said first inner flat panel; and a second door having a second hollow interior, a second inner flat panel, and a plurality of second holes on said second inner flat panel, and said first door and said second door are moveable between an open position and a closed position.

20. The refrigerated case as recited in claim 1 wherein the refrigerated cases defines a chamber, and said cool air enters said chamber through said plurality of holes.

21. The refrigerated case as recited in claim 1 wherein said inner panel is flat.

* * * * *